US006749481B1

(12) United States Patent
Yap et al.

(10) Patent No.: US 6,749,481 B1
(45) Date of Patent: Jun. 15, 2004

(54) SOUND PRODUCING APPARATUS

(75) Inventors: Leong Kheng Yap, Singapore (SG); Tiang See Neo, Singapore (SG)

(73) Assignee: TechnoCracker Private Limited (SG)

( * ) Notice: Subject to any disclaimer, the term of this patent is extended or adjusted under 35 U.S.C. 154(b) by 0 days.

(21) Appl. No.: 09/763,938

(22) PCT Filed: Aug. 25, 1999

(86) PCT No.: PCT/SG99/00088

§ 371 (c)(1),
(2), (4) Date: Feb. 27, 2001

(87) PCT Pub. No.: WO00/12187

PCT Pub. Date: Mar. 9, 2000

(30) Foreign Application Priority Data

Aug. 31, 1998 (SG) ..... 9803362

(51) Int. Cl.[7] ..... A63H 5/00

(52) U.S. Cl. ..... 446/213; 446/176; 446/211; 446/475; 124/74

(58) Field of Search ..... 446/475, 176, 446/211, 213, 398; 124/74

(56) References Cited

U.S. PATENT DOCUMENTS

| | | | | |
|---|---|---|---|---|
| 1,324,092 A | * | 12/1919 | Worswick | 446/398 |
| 1,502,611 A | * | 7/1924 | Boedecker | 446/475 |
| 5,015,211 A | | 5/1991 | Reveen | |
| 5,149,290 A | * | 9/1992 | Reveen | 446/475 |
| 5,181,775 A | * | 1/1993 | Lan | 446/398 |
| 5,354,225 A | * | 10/1994 | Hix | 446/475 |
| 5,529,527 A | * | 6/1996 | Watkins | 446/475 |
| 5,620,355 A | * | 4/1997 | Watkins | 446/475 |
| 5,634,840 A | | 6/1997 | Watkins | |
| 5,772,491 A | * | 6/1998 | Watkins | 446/475 |
| 5,803,791 A | * | 9/1998 | Chiles | 446/475 |
| 6,299,502 B1 | * | 10/2001 | Cheng | 446/475 |

FOREIGN PATENT DOCUMENTS

| | | | | |
|---|---|---|---|---|
| CN | 1110188 a | * | 10/1995 | A63H/5/04 |
| CN | 2269880 | | 12/1997 | |
| GB | 2197939 A | * | 6/1988 | F42B/4/24 |
| RU | 1710086 | | 5/1989 | |

OTHER PUBLICATIONS

Stage Equipment and Lighting, Inc. (www.seal–fla.com/confetti/confetti.htm). copyright 2002.*

Aerotechnics—Confetti Launchers—Aero Cannons (www-.fun–shop.com/special_effects/confetti_launchers.htm), copyright 1996.*

Patent Office of People's Republic of China Notification of First Office Action, Aug. 16, 2002, 8 pages (includes translation).

AEROTECHNICS™ "Cannon Line: Indoor/Outdoor AirCannon Single Barrel—Double Barrel Air/Electric Operated", http://www.aerotechnic.com/cannon8.htm; copyright 1998–2002, 3 pages.

Shillinger, Paul, Jr. SLT: "Aerotechnics (tm) and You", http://slidell–slt.org/articles/theatrefx_16.htm, Apr. 11, 2001, 3 pages.

* cited by examiner

*Primary Examiner*—Derris H. Banks
*Assistant Examiner*—Urszula M Cegielnik
(74) *Attorney, Agent, or Firm*—Dorsey & Whitney LLP

(57) ABSTRACT

Sound producing apparatus (20) is disclosed which simulates a fire cracker. The apparatus comprises a selectively actuatable aerosol (24) which fills a chamber (35) with compressed fluid which, when a certain pressure is reached, blows off a cap (38) creating a shower of confetti (39) and a loud bang. In other embodiments, a plurality of elastomeric members filled with compressed air which are ruptured or a selectively operable compressed fluid container formed by the apparatus housing, art used to create a similar effect.

44 Claims, 13 Drawing Sheets

SOUND PRODUCING APPARATUS

FIELD OF THE INVENTION

This invention relates to sound producing apparatus more particularly, but not exclusively, to fireworks and fire crackers.

BACKGROUND OF THE INVENTION

Fireworks and, in Chinese culture, fire crackers form an integral part of many celebrations, such as at Chinese New Year, opening ceremonies and birthdays. In recent years, however, the use of fireworks and fire crackers has been restricted and in some countries such as Hong Kong and Singapore such use is forbidden, due to the inherent safety hazards of such products.

It is the object of the invention to provide a sound producing apparatus which alleviates this disadvantage of conventional fireworks and fire crackers.

SUMMARY OF THE INVENTION

According to the invention, there is provided sound producing apparatus comprising a container arranged to contain compressed fluid; and a chamber in selective fluid communication with the container, the chamber having an outlet arranged to open when fluid pressure in the chamber exceeds a threshold.

The apparatus preferably further comprising a housing which either forms or contains the container and/or the chamber.

The container may be a pressure pack dispenser or an aerosol having an outlet valve and may further comprise a housing in which the container is movable between a first position in which the valve is opened and a second position in which the valve is closed and a stop member which engages and opens the valve in the first position.

The container may be formed from an elastomeric material and the apparatus preferably further comprises a rupture member for rupturing the container, the rupture member preferably being a pin member or a piston member. At least one further container may be provided, the containers being openable one after the other.

The container and chamber are preferably connected by at least one selectively operable valve means which may comprise (1) a valve member slidable in a valve sleeve, the valve member and sleeve having openings which in an open position align to allow fluid transfer through the valve or (2) a valve member slidable between open and closed positions relative to a sealing element, the valve member having a fluid passageway which in the open position allows fluid transfer past the sealing element and/or (3) a sleeve of elastomeric material covering a fluid transfer opening, the sleeve forming a one-way valve member.

The apparatus further preferably comprises means for controlling opening of the container and the controlling means may comprise a control fluid inlet for receiving a fluid control signal for opening the container or may comprise means for receiving an electrical control signal for opening the container.

The apparatus preferably farther comprises a sealing member covering the outlet, the sealing member being displaceable when the fluid pressure exceeds the threshold.

The sound producing apparatus is preferably in the exterior form of a fire cracker (or other explosive device) and confetti and/or a powdered material is/are preferably disposed in the chamber.

The compressed fluid may be gaseous such as air or liquid such as liquid petroleum gas or liquid propellant.

The invention extends to a plurality of sound producing apparatuses which may be connected together to resemble a string of fire crackers.

One sound producing apparatus is preferably associated with a delay means for delaying actuation of another sound producing apparatus.

The delay means may comprise a valve includes a valve member resiliently biased towards a valve seat, the valve being openable in response to increased pressure against the valve member to force the valve member away from the valve seat or a rupture disc.

A source of compressed fluid is preferably connected to the sound producing apparatuses and a resilient elastomeric member may further be provided, the resilient elastomeric member being inflatable to beyond the point of rupture in response to introduction of fluid from said fluid source.

The delay means may comprise an electrical delay circuit.

In the described embodiments of the invention, a housing of the sound producing apparatus is in the exterior form of a fire cracker, the outlet being covered by a displaceable cap and a region adjacent the cap being filled with confetti and a fine powder, so that when the cap is displaced, a loud bang is heard as the fluid under pressure escapes and, at the same time, a shower of confetti and the powder, which simulates smoke, is expelled. The apparatus thus simulates a fire cracker without the associated dangers.

A plurality of sound producing apparatuses may be connected together to resemble the tree-like formation of a typical fire cracker. Each sound producing apparatus is connected to the next and actuated via a respective delay means so that one sound producing apparatus is actuated before the next and so on, to give a staggered series of bangs like a conventional fire cracker tree.

BRIEF DESCRIPTION OF THE DRAWINGS

Embodiments of the invention will now be described, by way of example, with reference to the accompanying drawings, in which.

DETAILED DESCRIPTION OF THE PREFERRED EMBODIMENT

Figure 1:
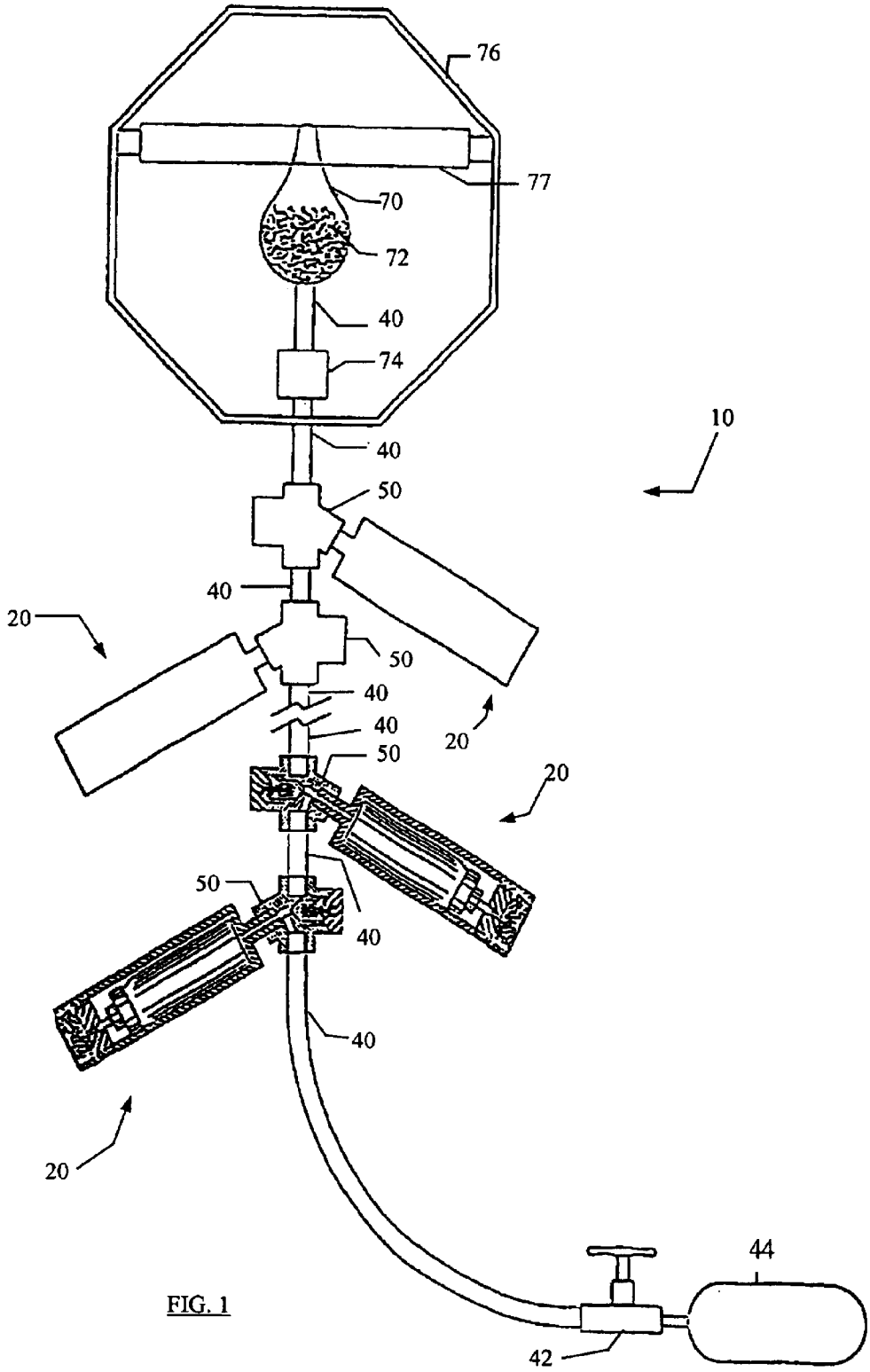
FIG. 1 is a part-sectional view of a simulated fire cracker tree incorporating an embodiment of sound producing apparatus of the invention.

With reference to FIG. 1, a simulated fire cracker "tree" generally designated 10 is shown. The simulated fire cracker tree is shaped, externally, to resemble the conventional one in which a plurality of fire crackers are connected together by a fuse, terminating in a single, larger "finale" cracker. In use, the fuse is lit and the fire crackers are exploded one after the other with the largest, loudest cracker being saved until last.

In the embodiment of the present invention now described, the conventional fire crackers are each replaced by a sound producing apparatus simply referred to hereafter as an "air cracker" 20. The air crackers 20 are connected together by tubes 40 via connectors 50. The first tube 40 is connected, at one end, to a source of compressed fluid (such as compressed air or liquid propellant) 44 via a valve 42. The last tube 40 is connected to a balloon 70 filled with confetti 72 via a throttle 74 to reduce airflow, the balloon 70 being enclosed in a paper housing 76. An ornamental scroll 77 is held in place by the housing 76.

Figure 2:
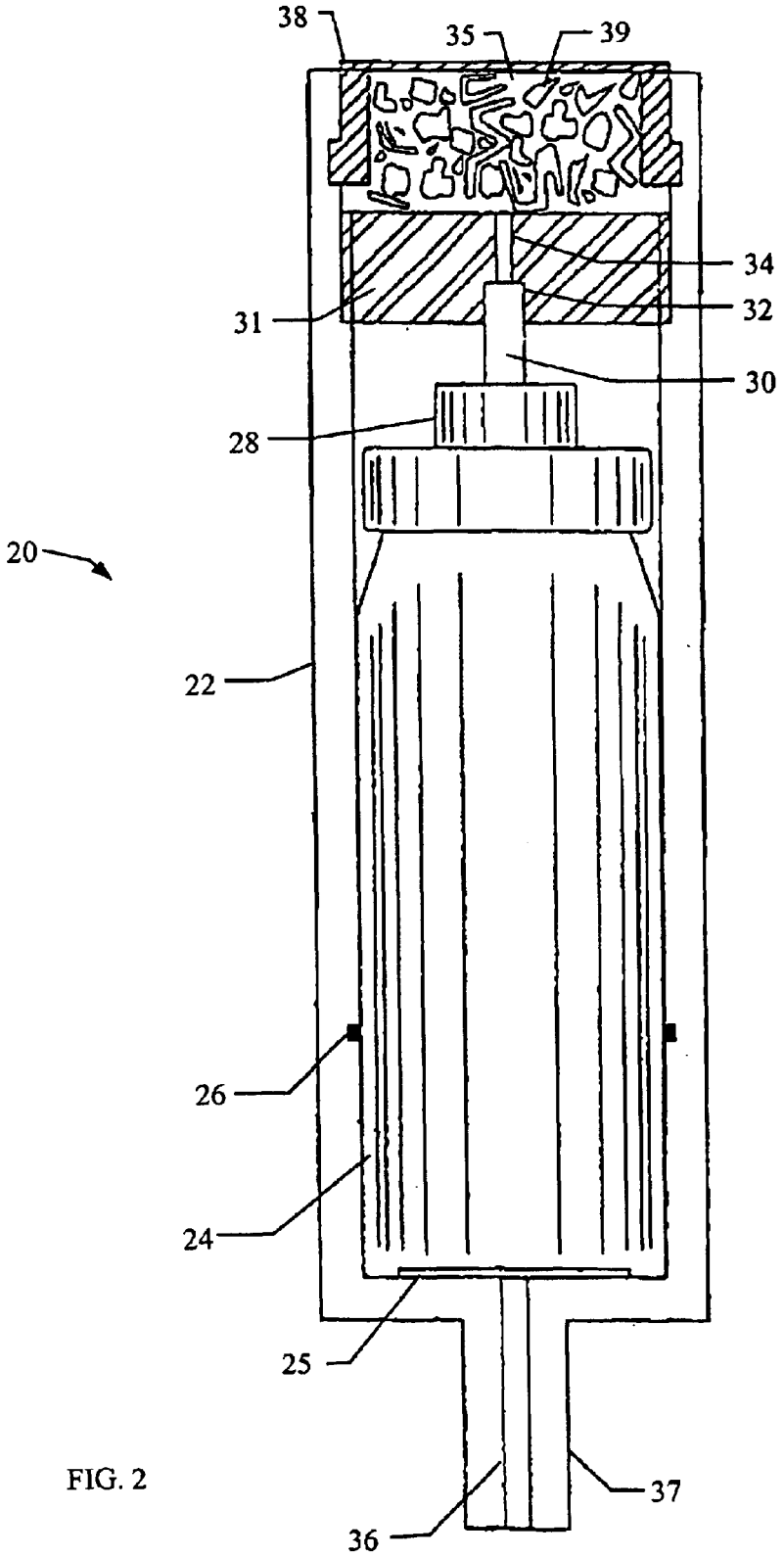
FIG. 2 is a cross-sectional view, on an enlarged scale, of the sound producing apparatus shown in FIG. 1.

The air cracker 20 is shown in more detail in FIG. 2 and comprises a hollow cylindrical housing 22 preferably formed from red plastics material in which a pressure pack dispenser or aerosol 24 containing a compressed fluid, preferably compressed air, is disposed. The dispenser is a snug but sliding fit in the housing 22 and an O-ring 26 forms a fluid seal between the housing 22 and aerosol 24. The dispenser is provided, at one end, with a depression-openable valve 28 and a fluid outlet 30. The valve is of a conventional construction so that upon depression of outlet 30, fluid under pressure can escape from aerosol 24. A cylindrical stopper 31 is held in housing 22 and receives the free end of outlet 30 in a cylindrical recess 32 which is in fluid communication with a cylindrical fluid outlet 34.

The housing 22 is provided, at one end, with a hollow cylindrical projection 37 forming a control fluid inlet 36. The dispenser is provided with a circular recess 25 at its base, in fluid communication with inlet 36. The housing at the other end is provided with a chamber 35 having displaceable sealing member or cap 38 formed, for example, from plastics material, cardboard or paper, the chamber 35 being filled with confetti 39.

Figure 3:
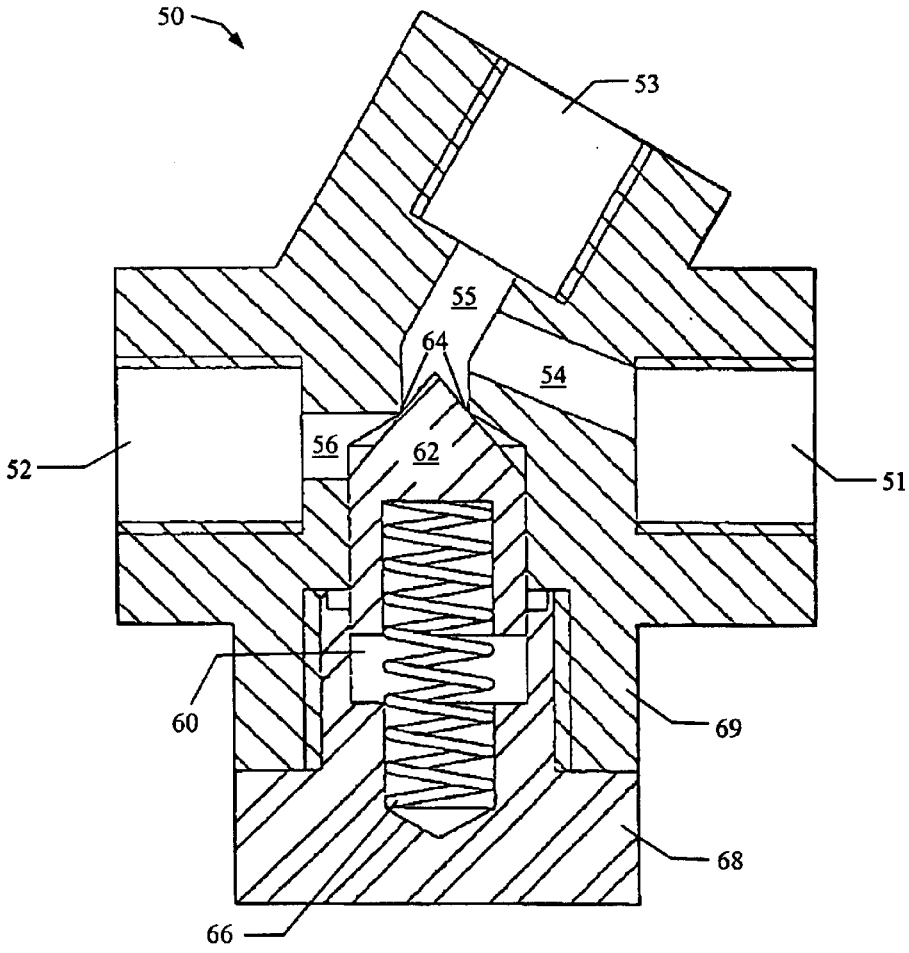
FIG. 3 is an enlarged cross-sectional view of a connector for connecting the sound producing apparatus to a fluid actuator source in the fire cracker tree of FIG. 1.

The air cracker 20 is attached to connector 50 shown in FIG. 3. Connector 50 has a valve body 69 with three cylindrical bores 51, 52, 53 formed therein. Cylindrical protrusion 37 of air cracker 20 is held in bore 53 and two tubes 40 are held in cylindrical bores 51, 52, by any convenient means. Bores 51–53 are in fluid communication via conduits 54, 55, 56. Conduits 54 and 55 which connect bore 51 which is connected to tube 40 closest to air supply 44 and bore 53 which is connected to air cracker 20, are in direct fluid communication. Conduit 55 is, however, connected to conduit 56 via a valve 60. Valve 60 comprises valve member 62 of conical form engaging a cylindrical knife edged valve seat 64. Valve member 62 is held in contact with valve seat 64 by means of a spring 66 held in place by means of a cap 68 which threadedly engages valve body 69.

In use, the air crackers 20 are assembled into a tree as shown in FIG. 1. When a user desires to actuate the air crackers 20, valve 42 is opened allowing air under pressure to pass from reservoir 44 along tube 40. When the first connector 50 is reached, the air under pressure, through conduits 54, 55 enters control fluid inlet 36. The resulting increased pressure acts on the recess 25 of aerosol 24 causing the aerosol to move to the right in FIG. 2 against stopper 31, this causing fluid outlet 30 to be depressed relative to valve 28. Compressed air then rushes out of the aerosol 24 through outlet 34 quickly raising the pressure in chamber 35 adjacent displaceable cap 38 until the cap either ruptures or blows off the housing 22. At that point, due to the high pressure difference, a sudden pressure wave will be generated causing a loud bang, at the same time blowing the confetti 39 out of the air cracker 20, thus simulating the explosion of a fire cracker.

All air crackers 20 operate in the same way but, due to the operation of vales 50, do so one after the other in the manner of a conventional fire cracker tree. More specifically, with reference to FIG. 3, after valve 42 has been opened, conduits 54 and 55 will rise in pressure; as the pressure rises this will cause valve 60 to open by forcing valve member 62 back against spring 66 and away from valve seat 64, thus allowing compressed air from reservoir 44 to flow through conduit 55 to conduit 56 and thus to the next connector 50, so to actuate the next air cracker 20, and so on with a short time delay, dependent on the speed at which valve 60 opens, occurring between actuation of each air cracker . 20

After the last air cracker 20 has been actuated and the corresponding valve has opened, the compressed air from reservoir 44 flows via throttle 74 into balloon 72 which expands. The balloon ruptures paper casing 76, causing the scroll 77 to unroll and continues to expand until bursting, the confetti 72 in the balloon then being expelled as a shower.

Figure 4:
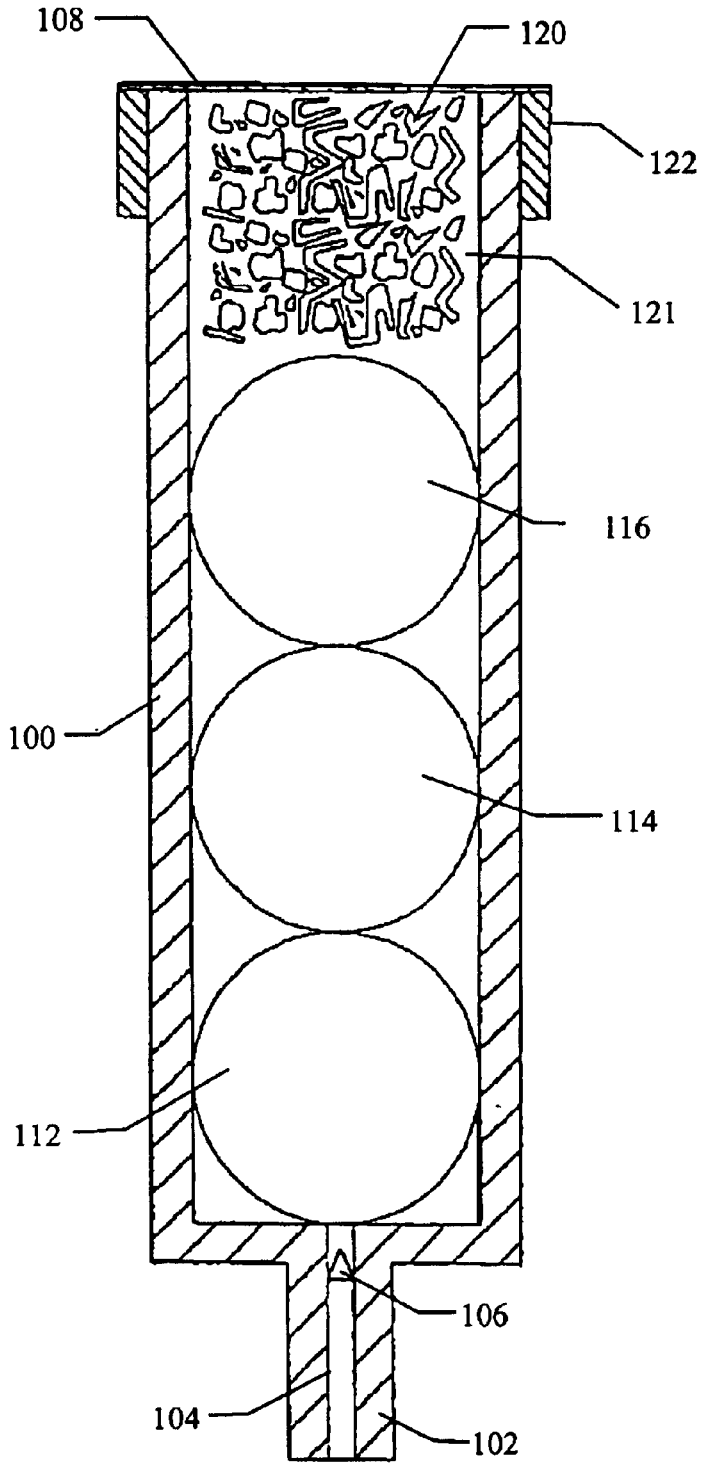
FIG. 4 is a cross-sectional view, similar to FIG. 2 of a second embodiment of the invention.

A second embodiment of the air cracker is shown in FIG. 4 in which housing 100 is similar to housing 22 of FIG. 2 but contains three spherical elastomeric containers 112, 114, 116, for example small inflated balloons, containing compressed air. At one end of container 100, a hollow cylindrical projection 102 connects to connector 50 in the same manner as the embodiment of FIG. 2. Bore 104, however, contains a captured pin 106, of any conventional construction, which is resiliently biased within passage 104 but able to move into housing 100 and rupture container 112 in the same manner as applying a needle to a balloon, once pressure from reservoir 44 is received via connector 50. The substantially increased pressure within housing 100 when container 112 is ruptured will cause a knock-on effect, rupturing container 114 which in turn ruptures container 116. Confetti 120 is disposed in a chamber 121 between container 116 and opening 108 of housing 100. A cap 122 is placed over opening 108. When use, the rupturing of containers 112, 114, 116 will cause a blast of air to rupture or blow off cap 122, at the same time generating a staggered series of loud bangs and producing a shower of confetti.

Figure 5:
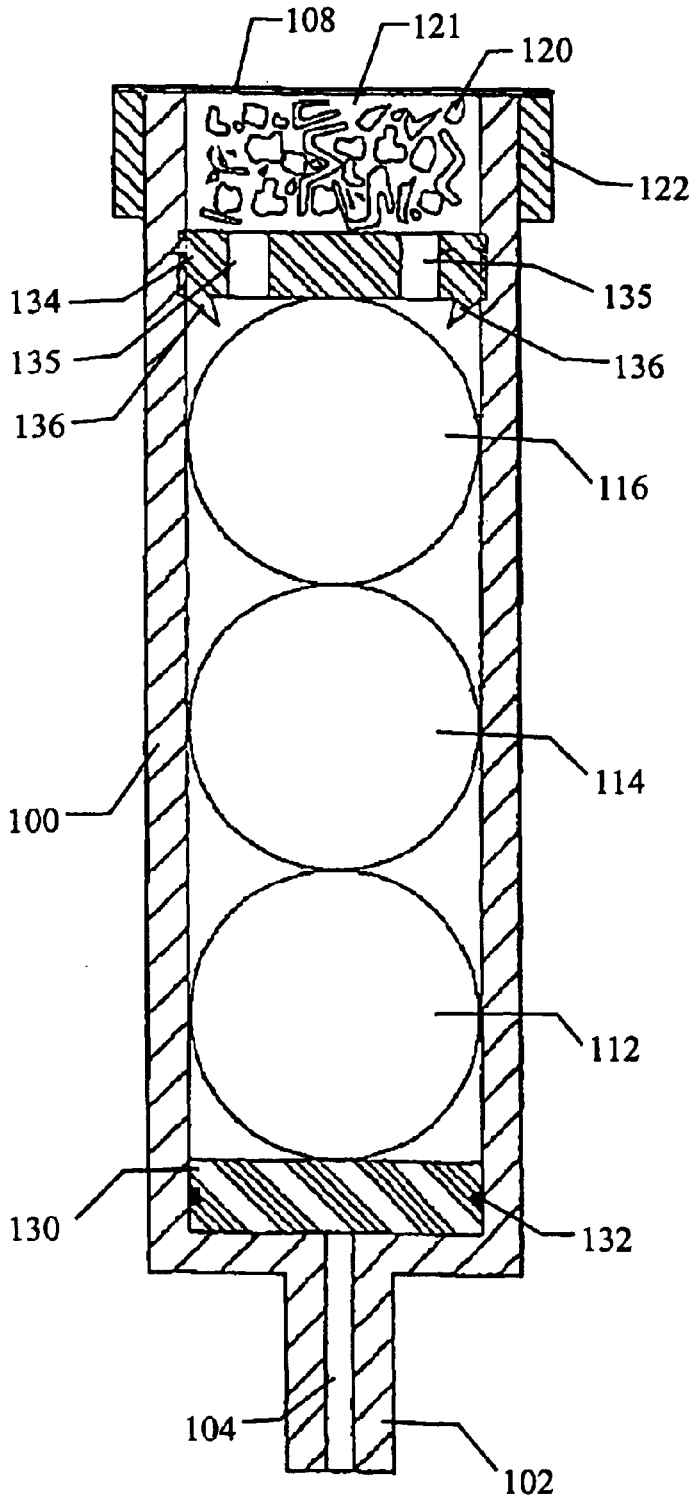
FIG. 5 is a cross-sectional view, similar to FIG. 2, of a third embodiment of the invention.

A third embodiment of the air cracker invention is shown in FIG. 5 which is similar to the embodiment of FIG. 4 except that (1) needle 106 is replaced by a cylindrical piston member 130 which is provided with a sealing O-ring 132 and (2) a stopper member 134 is securely connected to casing 100. In use, increased pressure in passageway 104 causes piston member 130 to compress containers 112, 114, 116 causing them to rupture. In order to assist this process, stopper member 134 may be provided with a plurality of prongs 136, to rupture container 116. The compressed air thus released then exits through openings 135, the air cracker operating as described with reference to FIG. 5.

Figure 6:
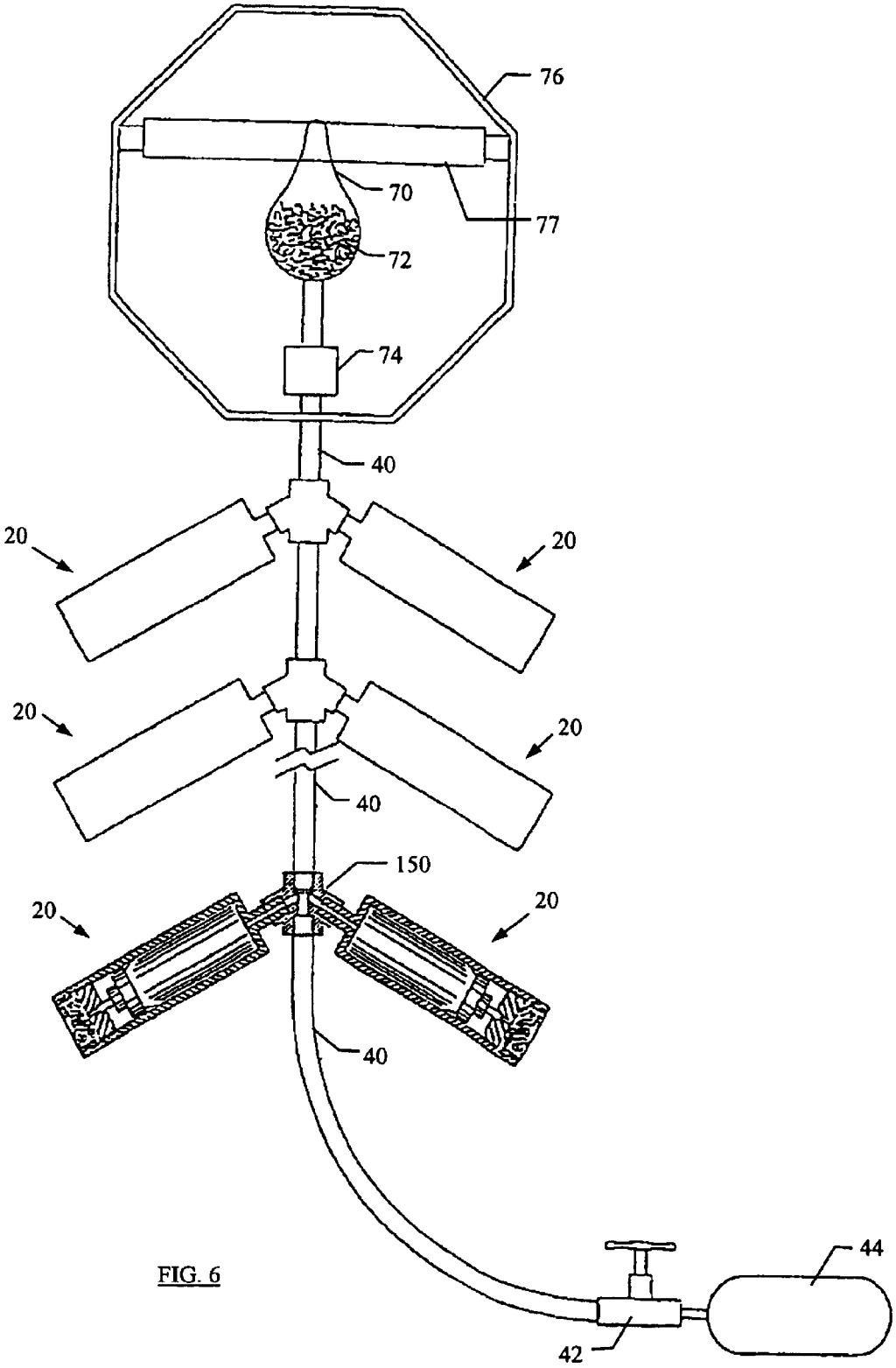
FIG. 6 is a view similar to FIG. 1 illustrating an alternative connector.
Figure 7:
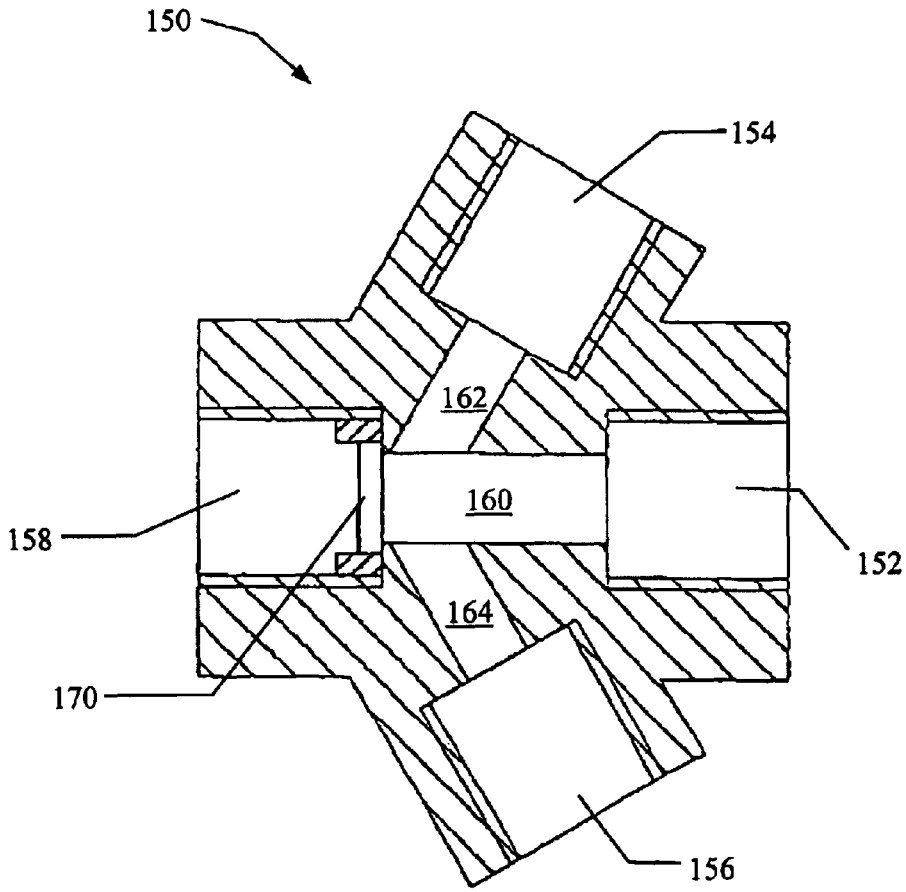
FIG. 7 is an enlarged sectional view of the connector shown in FIG. 6

A variation of the connector 50 is shown in FIGS. 6 and 7. In these figures, the air cracker tree is the same as that of FIG. 1, the only difference being connector 150.

As shown in more detail in FIG. 7, connector 150 has four connecting bores 152, 154, 156, 158. Bore 152 is connected to tube 40 and is nearest to compressed air source 44. Bores 154, 156 are connected to respective air crackers 20 and are in direct fluid communication with bore 152 via passageways 160, 162, 164. Bore 158 is connected to downstream air crackers via a rupture disc 170 and tube 40, the bursting of the rupture disc 170 due to increased pressure of a predetermined level causing a delay in the similar manner to valve 60 of FIG. 3.

Figure 8:
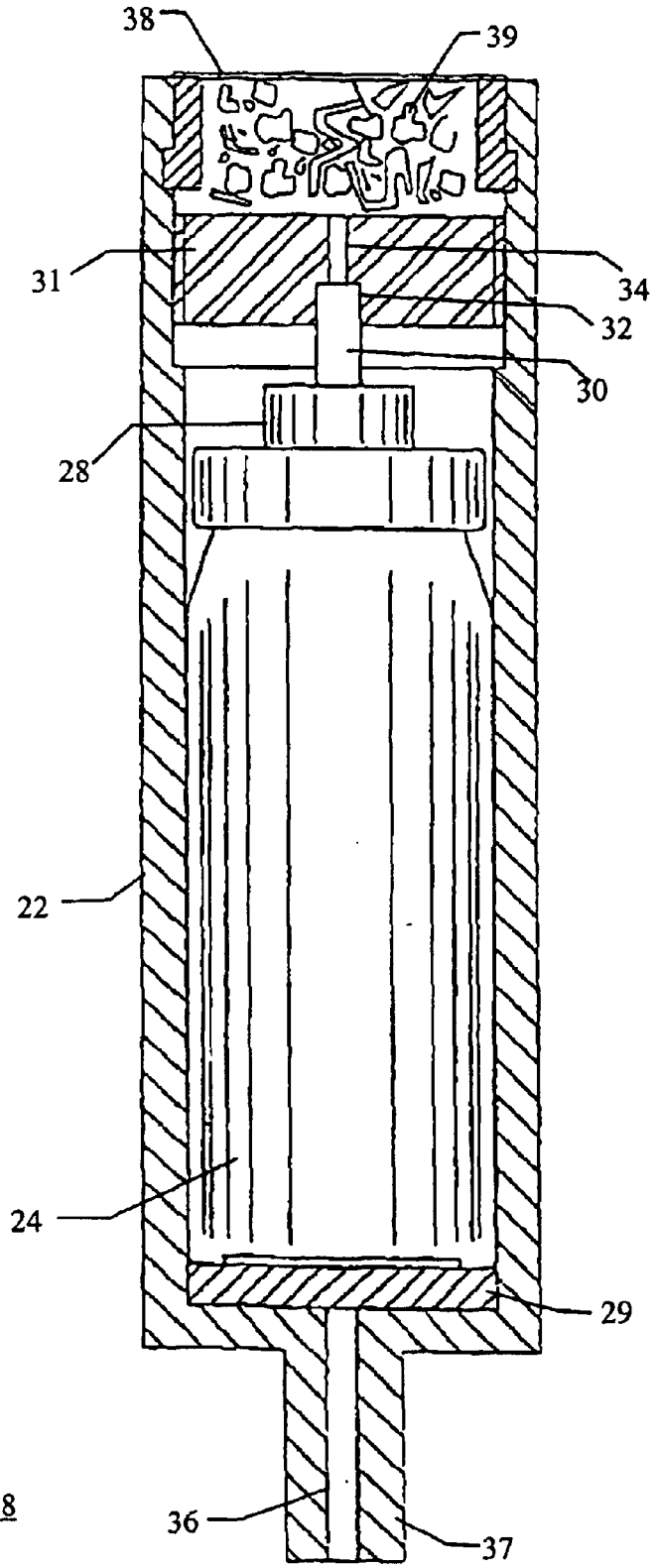
FIG. 8 is a cross-sectional view, similar to FIG. 2, of a fourth embodiment of the invention.

FIG. 8 shows a fourth embodiment of the invention which is the same as FIG. 2 except that the O-ring 26 has been replaced by a cylindrical rubber piston member 29. The operation of the embodiment of FIG. 8 is the same as that of FIG. 2 except that when air under pressure enters through control inlet 36, this acts on piston member 29 to force piston member 29 against aerosol 24 and move with it as valve 28 opens.

Figure 9:
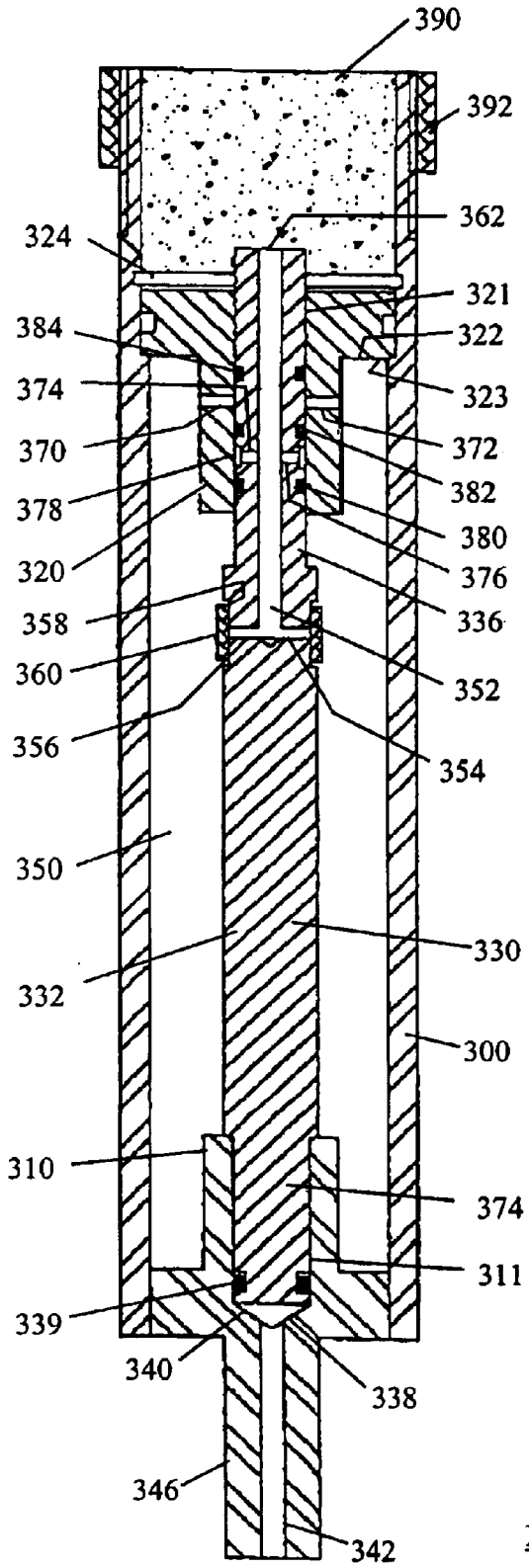
FIG. 9 is a cross-sectional view, similar to FIG. 2, of a fifth embodiment of the invention.
Figure 10:
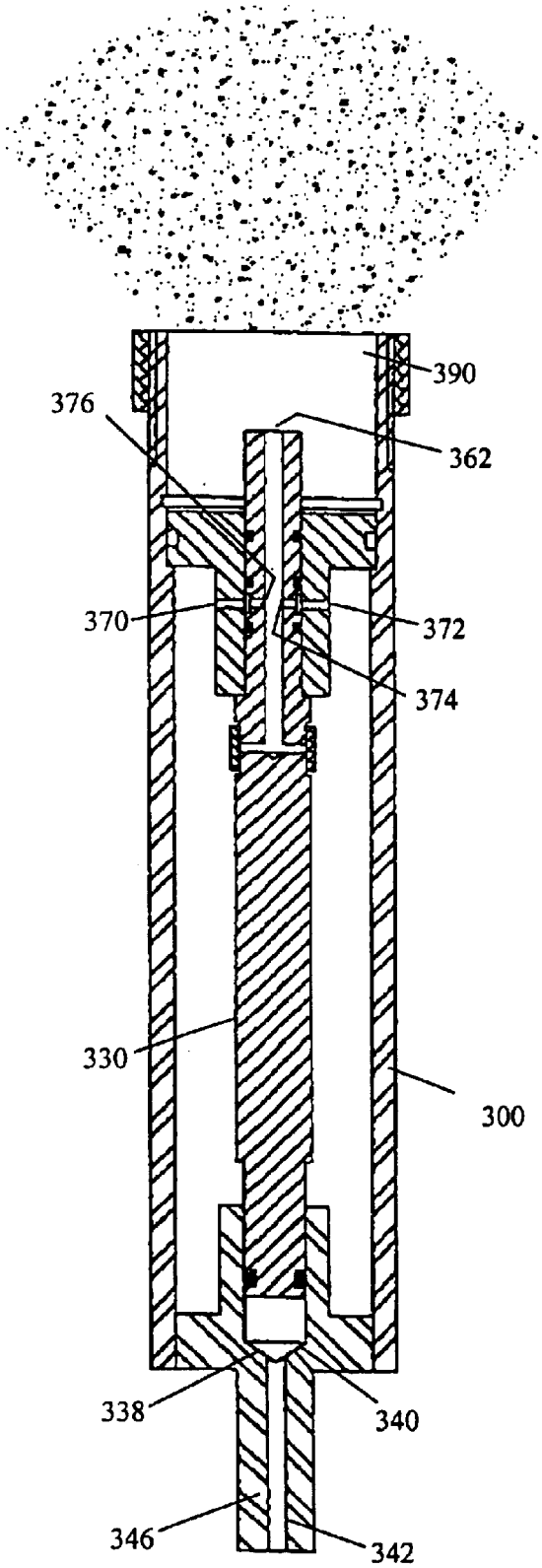
FIG. 10 is a cross-sectional view of the embodiment of FIG. 9 once actuated.

A fifth embodiment of invention is illustrated in FIGS. 9 and 10. In this embodiment, part of the air cracker housing forms the container of the previous embodiments. Specifically, hollow cylindrical housing 300 is provided with two spaced cylindrical elements 310, 320, each having a co-axial bore 311, 321. Element 310 is secured to and forms an end of housing 300. Element 320 includes a cylindrical base portion 322 which rests on a shelf 323 of housing 300. Portion 322 is held adjacent the shelf by a circlip 324.

A valve member 330 is disposed between the elements. A central portion 332 of member 330 is connector to narrower end portions 334 and 336 which are slidable in the respective bores 311, 321. Ridges formed between the narrower portions 334, 336 and central portion 332 limit the degree of sliding travel of the member 330 which can move from a closed position shown in FIG. 9 to an open shown in FIG. 10. Bore 311 is connected at one end to a bore 342 formed in a projection 346 to provide a control fluid inlet in the same manner as previous embodiments. End portion 334 is provided with a sealing O-ring 339 which sits in a corresponding annular recess to prevent fluid leakage along bore 311.

A generally hollow cylindrical chamber 350 is formed between housing 300 and member 330 and the chamber 350 is arranged to be filled with compressed fluid in the manner of the previous embodiments. End portion 336 and element 320 together provide a valving means to enable the space 350 to be filled with compressed fluid and for compressed fluid to be discharged therefrom. For filling, end portion 336 is provided with a hollow cylindrical bore 352 which connects, at one end, to a pair of radially extending bores 354, 356. The free ends of bores 354, 356 lie in an annular channel 358 in which a sleeve 360 formed from rubber or other elastomeric material is disposed. Free end 362 of bore 352 is connectable to a source of compressed air (or other compressible fluid). In use, sleeve 360 acts as a one way valve so that compressed air from opening 362 will enter space 350 via bores 352, 354, 356, pushing open sleeve 360. The compressed air in space 350 will, after filling, force sleeve 360 into contact with the openings of bores 354, 356, thus sealing a connection and preventing the compressed air from being expelled.

Valving to allow air to be expelled from space 350 is provided by two radial bores 370, 372 formed in element 320 and a further pair of radial bores 374, 376 formed in end portion 336 which are connected at one end to an annular channel 378 and at the other to bore 352. O-rings 380, 382 and 384 prevent leakage of compressed fluid along bore 321.

End 362 of bore 352 projects into a chamber 390 filled with confetti. A sealing member or cap 392 of the same design as the previous embodiments covers the chamber 390.

In use, the space 350 is filled with compressed air and the chamber 390 packed with confetti and sealed with cap 392. When it is desired to actuate the air cracker, compressed air is applied through bore 342 to move member 330 from the position shown in FIG. 9 to that shown in FIG. 10 at which bores 370, 372 align with bores 374, 376 and annular recess 378, causing air to be expelled from space 350 into chamber 390. The pressure in chamber 390 builds up until cap 392 either ruptures or blows off causing a loud bang and the confetti to be expelled in the manner of the previous embodiments.

Figure 11:
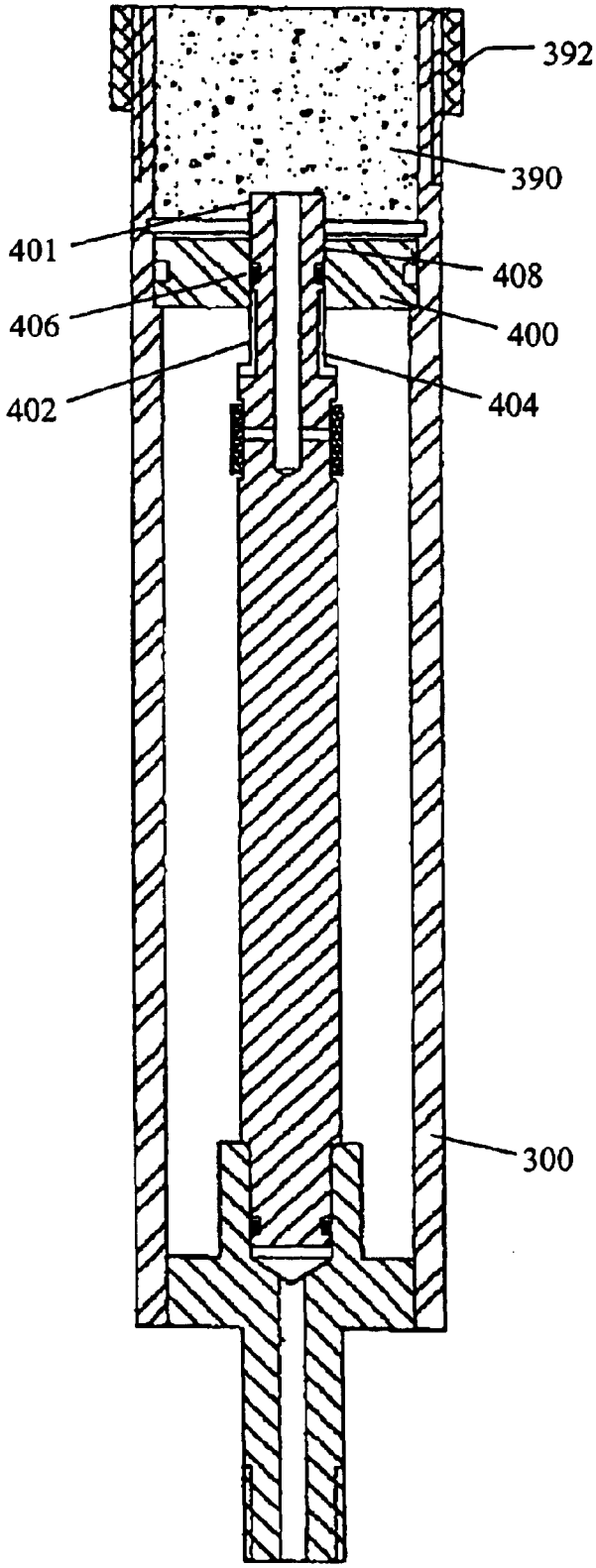
FIG. 11 is a cross-sectional view, similar to FIG. 2, of a sixth embodiment of the invention.
Figure 12:
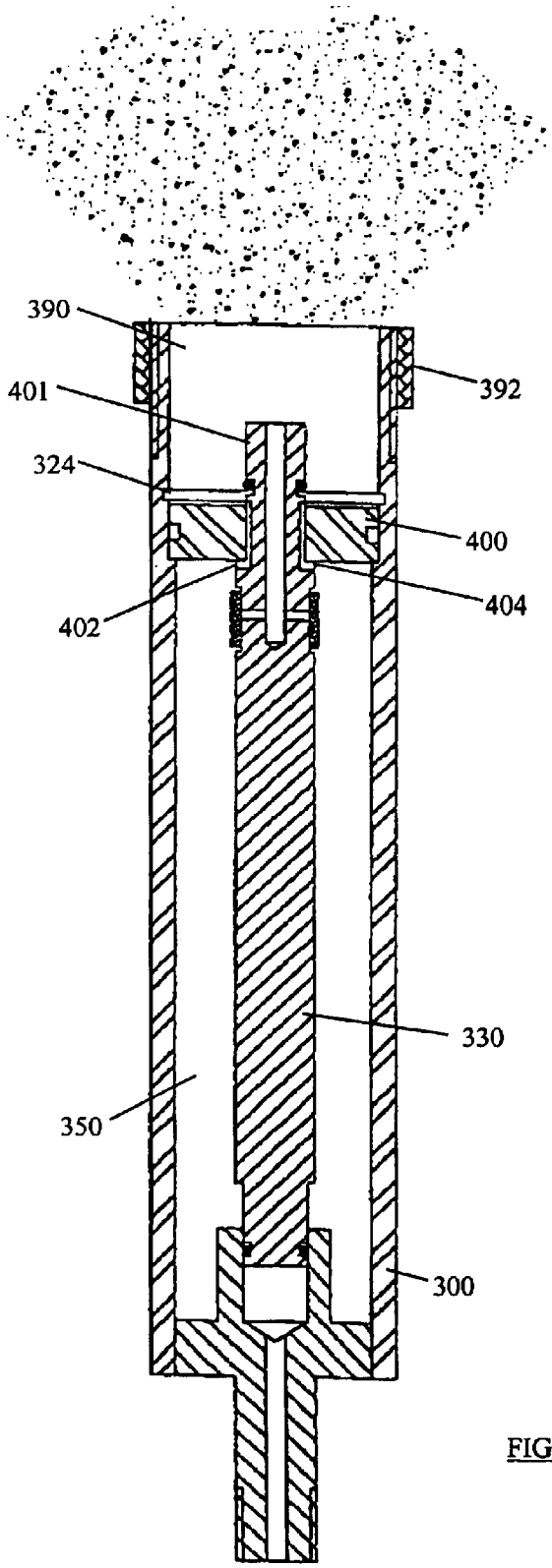
FIG. 12 is a cross-sectional view of the sixth embodiment, once actuated.

A seventh embodiment is shown in FIGS. 11 and 12. The seventh embodiment is substantially the same as the sixth embodiment except that element 400 is now in the form of a cylindrical sealing disk in the central bore 408 of which a cylindrical end portion 401 of member 330 is slidably received. Bores 370–376 of the embodiment of FIG. 6 have been replaced by two axial grooves 402, 404 in portion 401 which are of a length greater than the width of disk 400. A sealing O-ring 406 is provided to prevent leakage of compressed air along the bore 408.

As shown in FIG. 11, which shows the air cracker in a charged position, the slots 402, 404 do not communicate with chamber 390 and, any seepage of air is blocked by O-ring 406. When actuated, shown in FIG. 12, the grooves 402, 404 connects space 350 with chamber 390, thus allowing air to enter chamber 390 increasing the pressure in the chamber until the cap ruptures or blows off expelling the confetti as shown.

Figure 13:
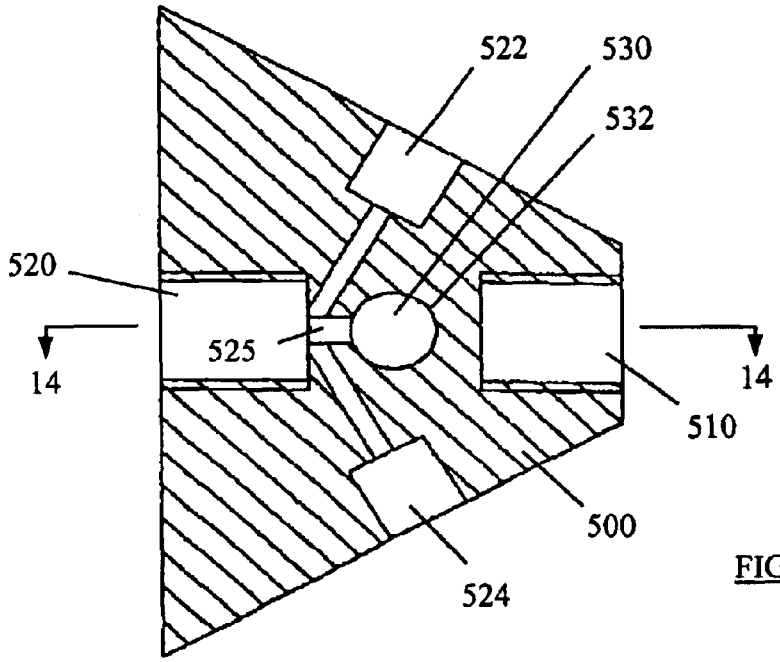
FIG. 13 is a cross-sectional view similar to FIG. 7 illustrating a second alternative connector.
Figure 14:
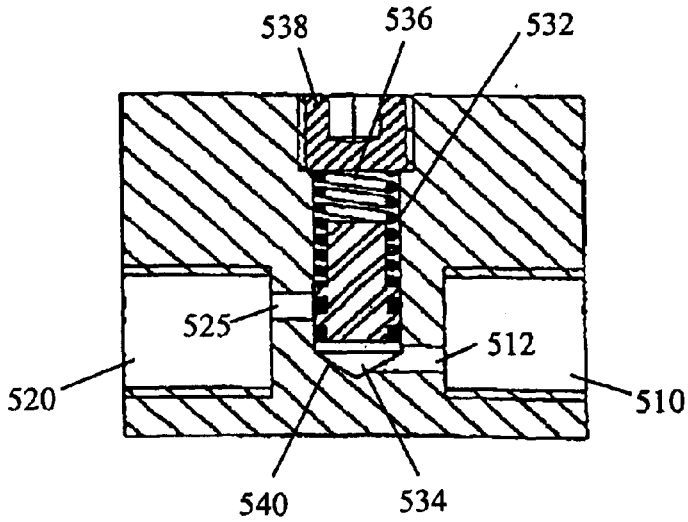
FIG. 14 is a cross-sectional view across 14—14 of FIG. 13.

A third form of valve member similar to that shown in FIG. 6, is shown in FIGS. 13 and 14. A valve body 500 is provided with a compressed air inlet 510 and a compressed air outlet 520 to which are connected first 525 and second 524 connectors to which air crackers are respectively attached. Inlet 510 and outlet 520 are further connected by means of a valve 530. This connection is shown in more detail in FIG. 14. Inlet 510 is connected by means of a bore 512 to a valve chamber 532 in which a valve member 534 sits. The valve member 534 is biased by a spring 536 held in place by a cap 538 towards a valve seat 540. The valve member 534 is a conical shape so that air pressure applied through bore 512 will tend to act against the bias of spring 536, so that when the pressure is great enough, this will force up the valve member 534 to the point where bore 512 is in communication with a bore 525 connected to outlet 520, so that the compressed air may be supplied to the air crackers connectors 522, 524. The inertia of the valve provides a time delay for actuation of the air crackers through connectors 522, 524, as before.

The confetti may be mixed with a fine powder to provide the impression of smoke. Preferably the powder is flour or talcum powder.

The embodiments of the invention described above are not to be construed as limitative. For example, actuation control of the air crackers has been effected in the described embodiments by fluid means. This could be achieved by any other suitable means, for example electrical (solenoid) operation with the delay valves being replaced by delay circuits. Furthermore, the air crackers need not be disposed as part of an air cracker tree, but may be used separately to represent a single firework, fire cracker, thunder flash or a simulated explosion device such as a mortar simulator. When forming part of a tree, some or all of the delay means may be omitted, depending on the effect desired.

What is claimed is:

1. A sound producing apparatus comprising a plurality of sound producers operatively connected together, each sound producer comprising a container arranged to contain compressed fluid and a chamber in selective fluid communication with the container, the chamber having an outlet arranged to open upon actuation of the sound producer to release the fluid when fluid pressure in the chamber exceeds a threshold, and the apparatus further comprising delay means arranged to stagger actuation of the sound producers.

2. The sound producing apparatus of claim 1 further comprising a housing forming the container.

3. The sound producing apparatus of claim 1 further comprising a housing containing the container.

4. The sound producing apparatus of claim 2 wherein the housing forms the chamber.

5. The sound producing apparatus of claim 3 wherein the housing forms the chamber.

6. The sound producing apparatus of claim 1 wherein the container is in the form of a pressure pack dispenser or an aerosol having an outlet valve.

7. The sound producing apparatus of claim 6 further comprising a housing in which the container is movable between a first position in which the valve is opened and a second position in which the valve is closed.

8. The sound producing apparatus of claim 7 further comprising a stop member which engages and opens the valve in the first position.

9. The sound producing apparatus of claim 1 wherein the container is formed from an elastomeric material.

10. The sound producing apparatus of claim 9 further comprising a rupture member for rupturing the container.

11. The sound producing apparatus of claim 10 wherein the rupture member is a pin member or a piston member.

12. The sound producing apparatus of claim 9 further comprising at least one further container, the containers being openable one after the other.

13. The sound producing apparatus of claim 10 further comprising at least one further container, the containers being openable one after the other.

14. The sound producing apparatus of claim 11 further comprising at least one further container, the containers being openable one after the other.

15. The sound producing apparatus of claim 1 wherein the container and chamber are connected by at least one selectively operable valve means.

16. The sound producing apparatus of claim 15 wherein a said valve means comprises a valve member slidable in a valve sleeve, the valve member and sleeve having openings which in an open position align to allow fluid transfer through the valve.

17. The sound producing apparatus of claim 15 wherein a said valve means comprises a valve member slidable between open and closed positions relative to a sealing element, the valve member having a fluid passageway which in the open position allows fluid transfer past the sealing element.

18. The sound producing apparatus of claim 15 wherein a said valve means comprises a sleeve of elastomeric material covering a fluid transfer opening, the sleeve forming a one-way valve member.

19. The sound producing apparatus of claim 16 wherein a said valve means comprises a sleeve of elastomeric material covering a fluid transfer opening, the sleeve forming a one-way valve member.

20. The sound producing apparatus of claim 17 wherein a said valve means comprises a sleeve of elastomeric material covering a fluid transfer opening, the sleeve forming a one-way valve member.

21. The sound producing apparatus of claim 1 further comprising means for controlling opening of the container.

22. The sound producing apparatus of claim 21 wherein the controlling means comprises a control fluid inlet for receiving a fluid control signal for opening the container.

23. The sound producing apparatus of claim 22 wherein the controlling means comprises means for receiving an electrical control signal for opening the container.

24. The sound producing apparatus of claim 1 further comprising a sealing member covering the outlet, the sealing member being displaceable when the fluid pressure exceeds the threshold.

25. The sound producing apparatus of claim 1 wherein said sound producer is in the exterior form of a fire cracker.

26. The sound producing apparatus of claim 25 wherein confetti or a powdered material is disposed in the chamber.

27. The sound producing apparatus of claim 1 wherein the compressed fluid is gaseous.

28. The sound producing apparatus of claim 1 wherein the compressed fluid is liquid petroleum gas or liquid propellant.

29. The sound producing apparatus of claim 1 wherein the plurality of sound producers are connected together to resemble a string of fire crackers.

30. The sound producing apparatus of claim 29 wherein one sound producer is associated with said delay means for delaying actuation of another sound producer.

31. The sound producing apparatus of claim 30 wherein the delay means comprises a valve including a valve member resiliently biased towards a valve seat, the valve being openable in response to increased pressure against the valve member to force the valve member away from the valve seat.

32. The sound producing apparatus of claim 30 wherein the delay means comprises a rupture disc.

33. The sound producing apparatus of claim 28 further comprising a source of compressed fluid connected to the apparatus.

34. The sound producing apparatus of claim 29 further comprising a source of compressed fluid connected to the apparatus.

35. The sound producing apparatus of claim 30 further comprising a source of compressed fluid connected to the apparatus.

36. The sound producing apparatus of claim 31 further comprising a source of compressed fluid connected to the apparatus.

37. The sound producing apparatus of claim 32 further comprising a source of compressed fluid connected to the apparatus.

38. The sound producing apparatus of claim 33 further comprising a resilient elastomeric member, the resilient elastomeric member being inflatable to beyond the point of rupture in response to introduction of fluid from said fluid source.

39. The sound producing apparatus of claim 34 further comprising a resilient elastomeric member, the resilient elastomeric member being inflatable to beyond the point of rupture in response to introduction of fluid from said fluid source.

40. The sound producing apparatus of claim 35 further comprising a resilient elastomeric member, the resilient elastomeric member being inflatable to beyond the point of rupture in response to introduction of fluid from said fluid source.

41. The sound producing apparatus of claim 36 further comprising a resilient elastomeric member, the resilient elastomeric member being inflatable to beyond the point of rupture in response to introduction of fluid from said fluid source.

42. The sound producing apparatus of claim 37 further comprising a resilient elastomeric member, the resilient elastomeric member being inflatable to beyond the point of rupture in response to introduction of fluid from said fluid source.

43. The sound producing apparatus of claim 30 wherein the delay means comprises an electrical delay circuit.

44. The sound producing apparatus of claim 1, wherein the fluid is released out of the apparatus when fluid pressure in the chamber exceeds the threshold.

* * * * *